United States Patent [19]

Matsumoto et al.

[11] Patent Number: 4,804,192

[45] Date of Patent: Feb. 14, 1989

[54] MOVABLE TARGET FOR A THROWING GAME

[75] Inventors: Hajime Matsumoto; Toshio Suzuki, both of Tokyo, Japan

[73] Assignee: Toybox Corporation, Tokyo, Japan

[21] Appl. No.: 192,125

[22] Filed: May 10, 1988

[30] Foreign Application Priority Data

Jun. 10, 1987 [JP] Japan ..... 62-89406

[51] Int. Cl.[4] ..... A63B 67/06

[52] U.S. Cl. ..... 273/336; 273/369; 273/370; 273/400

[58] Field of Search ..... 273/336, 338, 339, 337, 273/369, 370, 400

[56] References Cited

U.S. PATENT DOCUMENTS 4,519,787 5/1985 Williams ..... 446/313

FOREIGN PATENT DOCUMENTS

WO85/00054 1/1985 PCT Int'l Appl. .
188032 10/1922 United Kingdom ..... 273/338
666207 2/1952 United Kingdom .
688635 3/1953 United Kingdom .
2154890A 9/1985 United Kingdom .

*Primary Examiner*—William H. Grieb
*Attorney, Agent, or Firm*—Staas & Halsey

[57] ABSTRACT

A movable target for a throwing game is provided including a target body and a target member movably connected to the target body. The target body includes: a gear shaft cooperating with a drive mechanism; a rotary shaft mounted on the gear shaft; a rotary plate having an engagement projection and being loosely mounted on the rotary shaft; a rotary member having a projection formed on its upper surface mounted on the rotary shaft to be slidable longitudinally; a compression spring provided between the rotary plate and the rotary member; an oscillating member oscillatably supported on a supporting shaft passing through a base portion of the target member and a pair of bearing plates erected on the rotary plate, the oscillating member engaging at its upper end the target member; and a projection formed on an upper surface of said rotary member and fitted into a groove formed longitudinally on a lower end surface of the oscillating member. The target member is caused to rotate along with the rotary plate and, when the engagement projection formed on the rotary plate engages a cam mechanism cooperating with the drive mechanism, the rotary plate is prevented from rotating, but the target member oscillates via the oscillating member oscillated by engagement with the projection on the rotary member. Thus, the movable target irregularly rotates and oscillates to enhance the amusement value of a ring toss or ball throwing game.

13 Claims, 3 Drawing Sheets

MOVABLE TARGET FOR A THROWING GAME

BACKGROUND OF THE INVENTION

The present invention relates to games and, more particularly, to a movable target for use in a throwing game.

The target games of quoits (ring toss) and ball collecting are relatively simple and players tend to lose interest quickly. This is true especially when the target pole of quoits, and the target basket of a ball collecting game are of a fixed, nonmoving type.

Movable targets are known which are used in throwing or shooting games. These targets, however, are actuated by relatively large and complicated drive mechanisms. To date, there has not been developed a movable target for use in a throwing game for young children, such as quoits and a ball collecting game, that is relatively simple in structure and operation and which heightens the child's interest during play.

SUMMARY OF THE INVENTION

Accordingly, it is an object of the present invention to provide a moving target for a throwing game which is relatively simple in structure, can be used by young children and increases the amusement value of the game.

To achieve the foregoing and other objects of the present invention, and in accordance with the purposes of the invention there is provided a target body and a target member movably connected to an opening formed in an upper part of the target body. Located in the target body is a rotary shaft, having a tip portion of a polygonal shape, mounted on a gear shaft cooperating with a drive mechanism. A rotary plate is formed with an engagement projection rotatably fitted on the rotary shaft. On the rotary shaft, a rotary member having a projection on its upper surface is fitted slidably in the axial direction of the rotary shaft. A compression spring is mounted between the rotary plate and the rotary member. An oscillating member having a square shape in transverse section is oscillatably mounted on a supporting shaft passing through a base portion of the target member and a pair of bearing plates is erected on the rotary plate. The oscillating member is engaged at an upper end portion with the target member and a projection formed on the upper surface of the rotary member is fitted into a groove formed longitudinally on a lower end surface of the oscillating member. The target member rotates together with the rotary plate and, when the engagement projection of the rotary plate engages a cam mechanism, which rotates in cooperation with the drive mechanism to prevent the rotary plate from rotating, the target member oscillates via the oscillating member which oscillates by engaging the projection of the rotary member.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Figure 2:
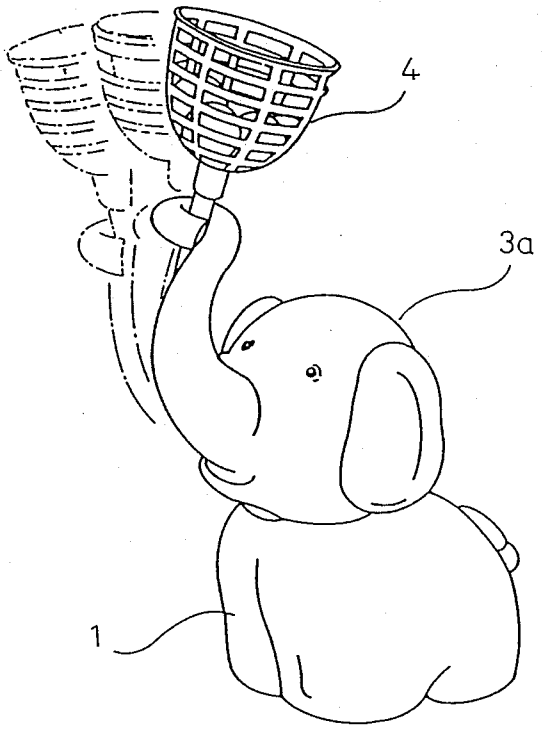
FIG. 2 is a perspective view of another embodiment of the movable target according to the present invention.
Figure 1:
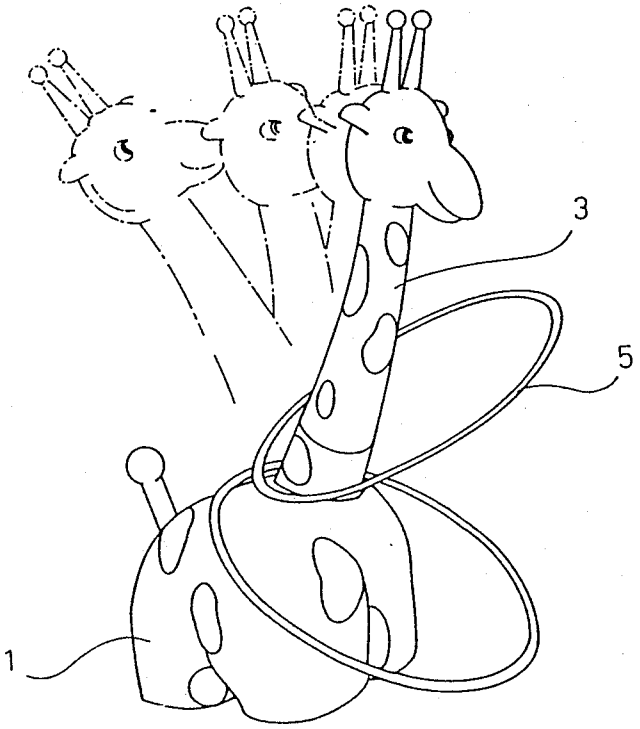
FIG. 1 is a perspective view of one embodiment of the movable target according to the present invention.

As shown in FIGS. 1 and 2, a target body 1 is formed to imitate the body of an animal. Target members 3, 3*a*, respectively are rotatably and oscillatably mounted to project from the target body 1.

The target member 3 shown in FIG. 1 is a movable target of a rod-like shape and is formed to imitate the head and neck of a giraffe. This target member 3 is used in, e.g., the game of quoits and is adapted to receive one or more rings 5 therearound.

The target member 3*a* shown in FIG. 2 is a movable target having a basket-shaped portion 4 and is formed to imitate the head and trunk of an elephant. This target member 3*a* is used in a ball collecting game.

Figure 3:
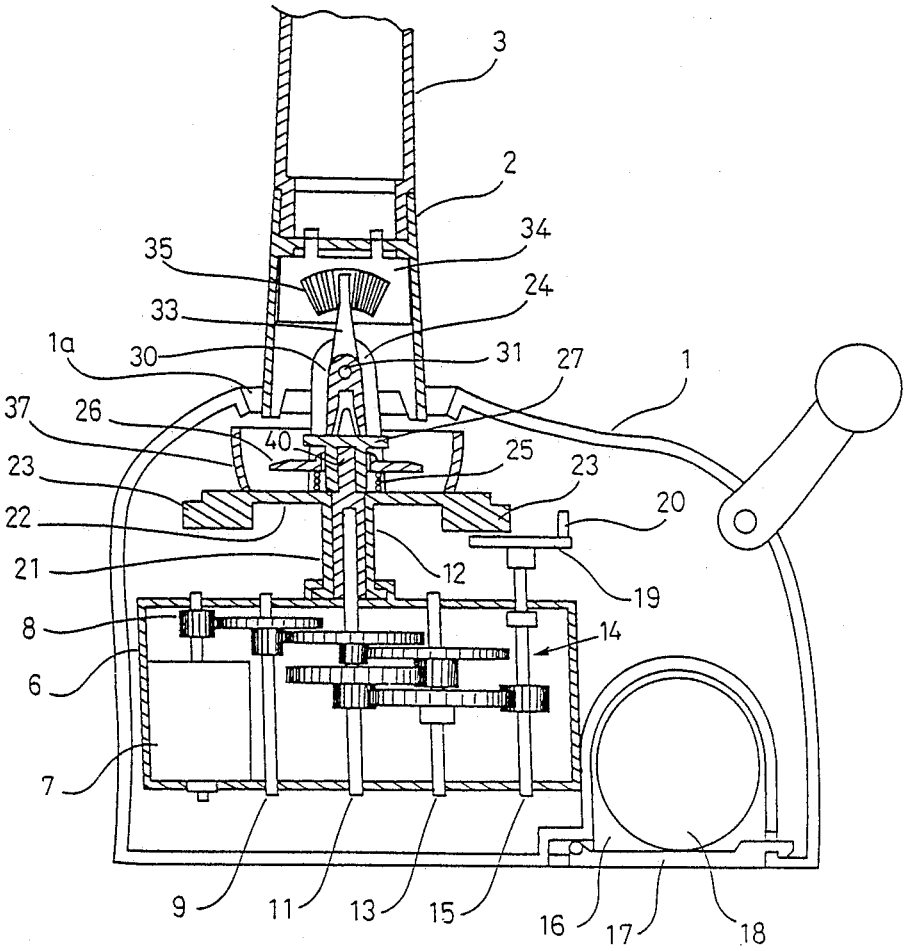
FIG. 3 is a vertical, cross sectional view showing the drive mechanism for the movable target.

As seen in FIG. 3, a housing 6 is arranged within the target body 1 and a cell containing portion 16 is formed at the bottom of the target body 1. In the cell containing portion 16, a battery cell 18 is placed. A lid 17 for the cell containing portion 16 is pivoted at the bottom of the target body 1 and is free to open and close.

A motor 7 is fixed within the housing 6 and a motor pinion 8 engages with a gear mounted on a gear shaft 9. On gear shafts 11, 13, 15, a plurality of gears 14 are fixedly and loosely mounted to transfer the rotary driving force to the gear shafts 11, 13, and 15.

Figure 4:
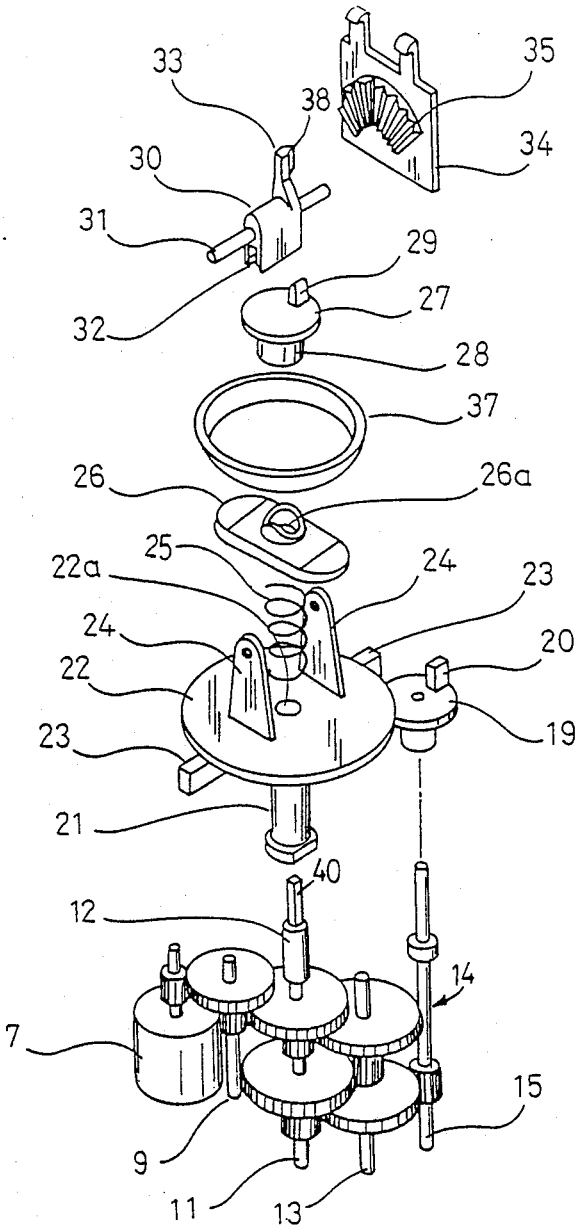
FIG. 4 is an exploded perspective view of the drive mechanism.

As seen in FIGS. 3 and 4, a rotary shaft 12 is mounted on the gear shaft 11 and projects toward a top portion of the housing 6. A tip portion 40 of the rotary shaft 12 is formed in a polygonal shape. The rotary shaft 12 is loosely fitted into a bearing hole 22*a* of a cylindrical member 21 formed integrally with a rotary plate 22 and the rotary plate 22 is rotatably journalled on the rotary shaft 12. On the outer peripheral edge of the rotary plate 22, a pair of engagement projections 23 are formed. These engagement projections 23 are adapted to engage a pin 20 formed on a cam plate 19 mounted on a top end of the gear shaft 15.

The polygonal tip portion 40 of the rotary shaft 12 projects above the top surface of the rotary plate 22 and is fitted with a rotary member 27. The rotary member 27 includes a bearing member 28 formed with a bearing hole of the same polygonal shape as the tip portion 40 of the rotary shaft 12. Accordingly, the rotary member 2 rotates along with the rotary shaft 12 and slides in the longitudinal direction of the rotary shaft 12.

A guard plate 26 is connected to the bearing member 28 of the rotary member 27, with the bearing member 28 loosely fitted into a through hole 26*a*. The guard plate 26 is slidable and swingable about the longitudinal direction of the bearing member 28. An upper end of a compression spring 25 contacts a lower surface of the guard plate 26 and a lower end of the compression spring 25 contacts a top surface of the rotary plate 22. A top surface of the guard plate 26 contacts a lower surface of the rotary member 27 due to the elastic force of the spring 25. Accordingly, the rotary member 27 is always biased upwardly by the spring 25. The guard plate 26 is adapted to engage a lower edge of a cylindrical member 2. The cylindrical member 2 is connected to the base portion of the target members 3, 3*a*. During the oscillating movement of the target members 3, 3*a* mentioned below, the guard plate 26 is adapted to engage with the lower edge of the cylindrical member 2 to prevent the abrupt inclination of the target members 3, 3*a* so as to moderate the swinging motion thereof, thus serving as a buffer mechanism.

The rotary plate 22 is also provided with a pair of upright bearing plates 24, between which an oscillation member 30 of a square shape in transverse section is arranged. The oscillation member 30 has an engagement projection 33 at its upper end. An engagement claw 38 formed at a front end of the engagement projection 33 engages teeth 35 formed on a middle plate 34 attached to the cylindrical member 2. On a lower end surface of the oscillating member 30, a fitting groove 32 is formed longitudinally. The oscillation member 30 is oscillatably mounted on a supporting shaft 31 passing through the cylindrical member 2 and the pair of bearing plates 24.

Consequently, the target members 3, 3*a* are fitted at their respective base portions to the cylindrical member 2 and are swingably supported by the pair of bearing plates 24 erected on the rotary plate 20. A projection 29 formed on an upper surface of the rotary member 27 is fitted into the groove 32 formed in the lower end of the oscillation member 30.

A ring member 37 is located on the top surface of the rotary plate 22. The ring member 37 serves to prevent the interior drive mechanism from being seen through an opening 1*a* formed in the target body 1.

Operation of the present invention will now be described.

When a switch (not shown) installed on the target body 1 is operated, the motor 7 turns and the gear shaft 11 rotates. Thus, the rotary shaft 12 mounted on the gear shaft 11 rotates and the rotary member 27 mounted at the tip portion 40 of the rotary shaft 12 also rotates. When the rotary member 27 rotates, the rotary plate 22, which is pressed by the lower end of the compression spring 25, cooperatively rotates, thereby rotating the target members 3, 3*a* attached to the cylindrical member 2. More particularly, the lower end of the compression spring 25, mounted between the rotary member 27 and the rotary plate 22, contacts compressively onto the upper surface of the rotary plate 22 directly, thus the rotary plate 22 is capable of cooperating with the rotary member to rotate by means of the compressed spring 25 force.

When a cam mechanism, constituted by a cam plate 19 mounted on the end of the gear shaft 15, and a pin 20, rotate to engage the engagement projection 23 provided on the rotary plate 22 so as to prevent the rotary plate 22, from rotating, the rotation of the target members 3, 3*a* is stopped. Because the projection 29 of the still rotating rotary member 27 engages the engagement groove 32 of the oscillation member 30, which has already stopped its rotation, the oscillation member 30 oscillates about the supporting shaft 31, serving as a fulcrum, to oscillate the target members 3, 3*a*. - When the engagement between the engagement projection 23 of the rotary plate 22 and the pin 20 is released, the rotary plate 22 rotates again to rotate the target members 3, 3*a*.

More particularly, the oscillating member 30, oscillatably journalled to the bearing plates 24 formed on the rotary plate 22, stops its rotation when the engaging projection 23 of the rotary plate 22 engages the cam mechanism which rotates in cooperation with the drive mechanism so as to prevent the rotary plate 22 from rotating. At this time, the rotary member 27 with the projection 29 fitted into the groove formed on the lower end surface of the oscillating member 30 is kept rotating, and the oscillating member 30 oscillates with its lower end surface sliding on the upper surface of the rotary member 27. Consequently, the target members 3, 3*a* engaged with the upper end portion of the oscillating member 30 can repeatedly rotate and oscillate.

The engagement teeth 35 formed radially in the cylindrical member 2 and the engagement claw 38 of the engagement projection 33 of the oscillation member 30 always engage each other to support the target members 3, 3*a*. However, when an external force is applied to the target members 3, 3*a*, the engagement claw 38 overrides the engagement teeth 35 so as to function as a clutch.

As mentioned above, the target members 3, 3*a* erected on the target body 1 repeatedly carry out a rotation movement and an oscillation movement, providing an irregularly moving target which heightens the interest in a throwing game.

The foregoing is considered illustrative only of the principles of the invention. Further, since numerous modifications and changes will readily occur to those skilled in the art, it is not desired to limit the invention to the exact construction and operation shown and described. Accordingly, all suitable modifications and equivalents may be resorted to that fall within the scope of the invention and the appended claims.

We claim:

1. A target for a throwing game, said target intended to receive an object thrown, comprising:

(a) a target body;

(b) a target member operatively and movably connected to the target body; and (c) means including a cam for repeatedly rotatably moving the target member relative to the target body, stopping the rotation and oscillating the target member relative to the target body.

2. The target as recited in claim 1, further comprising a receptacle on the target member for receiving an object that is thrown.

3. The target as recited in claim 1, wherein the target body is configured as a giraffe body and the target member is configured as a giraffe neck and head.

4. The target as recited in claim 1, wherein the target body is configured as an elephant and the target member is configured as an elephant head and trunk.

5. The target as recited in claim 4, wherein a basket is connected to the trunk to receive an object that is thrown.

6. A movable target for a throwing game, comprising:

(a) a target body;

(b) a target member movably connected o the target body;

(c) drive means connected to the target body;

(d) a cam mechanism cooperating with the drive mechanism;

(e) a gear shaft cooperating with the drive means;

(f) a rotary shaft mounted on the gear shaft;

(g) a rotary plate having an engagement projection loosely mounted on said rotary shaft;

(h) a rotary member having a projection on an upper surface thereof mounted slidable longitudinally on said rotary shaft;

(i) a compression spring provided between said rotary plate and said rotary member;

(j) a member oscillatably supported on a supporting shaft passing through a base portion of the target member and a pair of bearing plates erected on the rotary plate, said oscillating member engaging the target member;

(k) a projection erected on an upper surface of said rotary member fitted into a fitting groove formed on said oscillating member, wherein, when said drive means is actuated, said target member rotates along with said rotary plate and, when the engagement projection of the rotary plate engages the cam mechanism, the rotary plate is prevented from rotating and said target member is oscillated by the oscillating member engaged by the projection of said rotary member.

7. The target as recited in claim 6, wherein the rotary shaft includes a tip portion formed as a polygonal shaft to which the rotary member is mounted.

8. The target as recited in claim 6, wherein the oscillating member is square shaped in transverse section.

9. The target as recited in claim 6, wherein the moving means randomly oscillates and rotates the target member relative to the target body.

10. The target as recited in claim 6, further comprising a receptacle on the target member for receiving an object that is thrown.

11. The target as recited in claim 6, wherein the target body is configured as a giraffe body and the target member is configured as a giraffe neck and head.

12. The target as recited in claim 6, wherein the target body is configured as a elephant and the target member is configured as an elephant head and trunk.

13. The target as recited in claim 12, wherein a basket is connected to the trunk to receive an object that is thrown.

* * * * *